US010139753B2

(12) United States Patent
Nakajima

(10) Patent No.: US 10,139,753 B2
(45) Date of Patent: Nov. 27, 2018

(54) IMAGE FORMING APPARATUS HAVING CONTROLLED DRIVING FORCE

(71) Applicant: CANON KABUSHIKI KAISHA, Tokyo (JP)

(72) Inventor: Takao Nakajima, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/991,102

(22) Filed: May 29, 2018

(65) Prior Publication Data

US 2018/0275561 A1 Sep. 27, 2018

Related U.S. Application Data

(62) Division of application No. 15/298,602, filed on Oct. 20, 2016, now Pat. No. 10,012,930.

(30) Foreign Application Priority Data

Oct. 26, 2015 (JP) ..... 2015-209870

(51) Int. Cl.
*G03G 15/08* (2006.01)
*G03G 15/00* (2006.01)
(Continued)

(52) U.S. Cl.
CPC ..... *G03G 15/0879* (2013.01); *G03G 15/0872* (2013.01); *G03G 15/087* (2013.01);
(Continued)

(58) Field of Classification Search
CPC ..... G03G 15/0822; G03G 15/0832; G03G 15/0834; G03G 15/0836; G03G 15/0837; G03G 15/0863; G03G 15/0865; G03G 15/0867; G03G 15/087; G03G 15/0872; G03G 15/0877; G03G 15/0879;
(Continued)

(56) References Cited

U.S. PATENT DOCUMENTS 8,676,073 B2 3/2014 Murata et al.
8,989,633 B2 3/2015 Nakajima
(Continued)

FOREIGN PATENT DOCUMENTS

JP 2003-057930 A 2/2003
JP 2012-198360 A 10/2012
JP 2015-031737 A 2/2015

*Primary Examiner* — Joseph S Wong
(74) *Attorney, Agent, or Firm* — Fitzpatrick, Cella, Harper & Scinto

(57) ABSTRACT

A toner supply unit for use in an image forming apparatus includes a bottle gear provided on a toner bottle to receive a driving force when the toner bottle is mounted to a mounting portion, and a discharging mechanism provided on the toner bottle to discharge a predetermined amount of toner from a discharging portion with the rotation of the bottle gear. A controller controls the driving force inputted to the bottle gear in a period from input of the driving force to the bottle gear to a predetermined number of rotations of the toner bottle to be smaller than the driving force inputted to the bottle gear at a time when the discharging mechanism first discharges the predetermined amount of toner from the discharging portion after the predetermined number of rotations.

18 Claims, 12 Drawing Sheets

(51) Int. Cl.
*G03G 21/14* (2006.01)
*G03G 21/18* (2006.01)

(52) U.S. Cl.
CPC ..... *G03G 15/0822* (2013.01); *G03G 15/0832* (2013.01); *G03G 15/0834* (2013.01); *G03G 15/0836* (2013.01); *G03G 15/0837* (2013.01); *G03G 15/0863* (2013.01); *G03G 15/0865* (2013.01); *G03G 15/0867* (2013.01); *G03G 15/0877* (2013.01); *G03G 15/0881* (2013.01); *G03G 15/0886* (2013.01); *G03G 15/5008* (2013.01); *G03G 15/553* (2013.01); *G03G 15/556* (2013.01); *G03G 21/145* (2013.01); *G03G 21/1857* (2013.01)

(58) Field of Classification Search
CPC ..... G03G 15/0881; G03G 15/0886; G03G 15/5008; G03G 15/553; G03G 15/556; G03G 21/145; G03G 21/1857
See application file for complete search history.

(56) References Cited

U.S. PATENT DOCUMENTS

| | | | | |
|---|---|---|---|---|
| 9,291,990 | B2 | 3/2016 | Iikura et al. | |
| 2013/0142523 | A1* | 6/2013 | Yamaoka ..... | G03G 21/1896 399/12 |
| 2013/0259534 | A1 | 10/2013 | Maeshima | |
| 2014/0169835 | A1 | 6/2014 | Nakajima | |
| 2015/0037051 | A1 | 2/2015 | Iikura et al. | |
| 2016/0161892 | A1 | 6/2016 | Iikura et al. | |

* cited by examiner (a)

(b)

(a)

(b)

(a)

(b)

IMAGE FORMING APPARATUS HAVING CONTROLLED DRIVING FORCE

This application is a divisional of application Ser. No. 15/298,602, filed Oct. 20, 2016.

FIELD OF THE INVENTION AND RELATED ART

The present invention relates to an image forming apparatus provided with an accommodating container for accommodating a developer.

An image forming apparatus is known which is provided with the accommodating container (toner bottle) accommodating the developer in which toner is discharged through a discharge opening of the toner bottle with the rotation of the toner bottle to supply the toner into a developing device. In use of such a toner bottle, it is preferable that a rotational speed of the toner bottle can be controlled with high precision in order to control the discharge amount of the toner with high precision.

In an example of such a structure, the image forming apparatus includes a toner bottle provided with a pump portion driven with the rotation of the bottle, a driving motor for rotating the toner bottle, and a motor control IC for controlling the rotational speed of the driving motor (Japanese Laid-open Patent Application 2015-31737). The image forming apparatus is provided with a flag type rotation sensor capable of detecting a rotational speed of the toner bottle. The motor control IC controls an output of the driving motor on the basis of a feed-back signal from the rotation sensor so that the rotational speed of the toner bottle approaches a target value.

It would be considered that the image forming apparatus is shipped with the accommodating container contained in the main assembly of the image forming apparatus in the state that the discharge opening of the accommodating container is closed, and the discharge opening is automatically opened when the image forming apparatus is installed. For example, there are provided an openable member capable of closing and opening the discharge opening of the developer accommodating container and a moving mechanism for moving the openable member using a part of the driving force transmitted to the accommodating container from the driving motor (driving device). With such a structure, it would be considered that the output of the driving motor is controlled using feed-back control as disclosed in Japanese Laid-open Patent Application 2015-31737). It would further be considered that an initial operation of opening the discharge opening by moving the openable member by the driving force from the driving motor and a developer discharging operation of discharging the developer by rotating the accommodating container after the initial operation are controlled using a series of feed-back controls.

However, in such a case in which the discharge opening is opened using a part of the driving force for driving the accommodating container, the load torque of the driving motor is different between during the initial operation and after the initial operation. The difference in the load torque results in a long period for reaching the rotational speed of the driving motor to the target value, and therefore, the stability of the rotational speed of the accommodating container is low.

SUMMARY OF THE INVENTION

Accordingly, it is an object of the present invention to provide an image forming apparatus in which the stability of the rotational speed of the accommodating container is high.

According to an aspect of the present invention, there is provided an image forming apparatus comprising an accommodating container including an accommodating portion configured to accommodate a developer and provided with a discharge opening configured to discharge the developer with rotation thereof; a receiving device configured to receive the developer discharged through said discharge opening; a driving device configured to rotate said accommodating container; a detecting portion configured to detect rotation of said accommodating container; an openable member movable between a closing position for closing said discharge opening and an opening position for opening said discharge opening; a moving mechanism configured to move said openable member from the closing position to the opening position in a state that said accommodating container is being rotated by said driving device, and to stop a driving force to said openable member after the movement of said openable member to the opening position; and a controller configured to operate said driving device with a predetermined fixed input value during a period in which said openable member moves from the closing position to the opening position and configured to switch an input value to said driving device on the basis of a signal from said detecting portion such that when said openable member is in the opening position, said accommodating container rotates at a predetermined speed.

Further features of the present invention will become apparent from the following description of exemplary embodiments with reference to the attached drawings.

Figure 4:
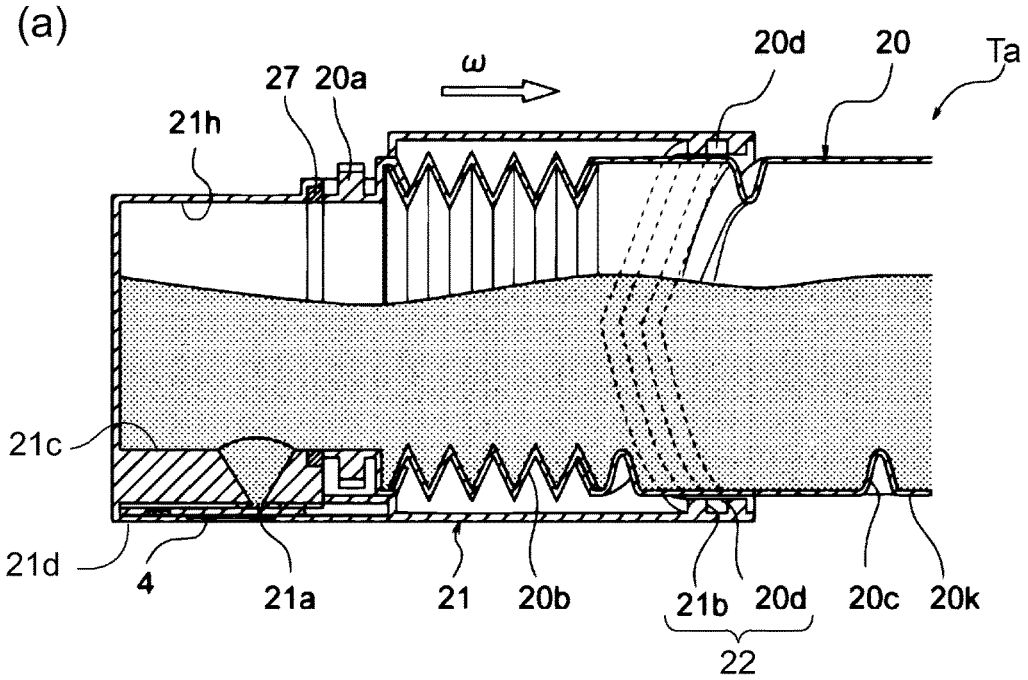
Figure 4:
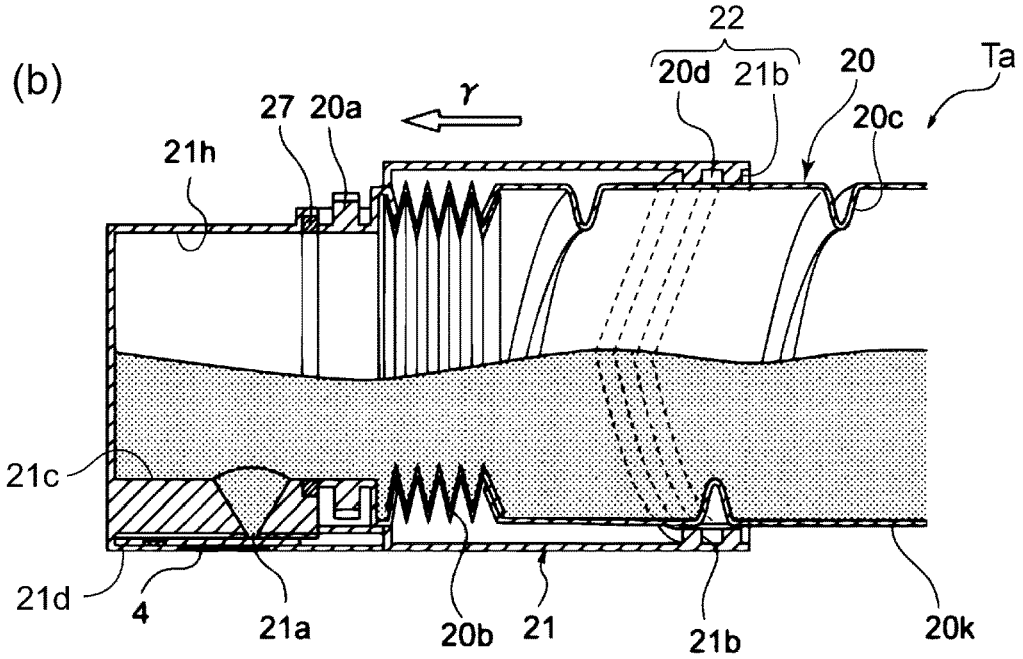

Part (a) of FIG. 4 is a sectional view of a toner bottle in which a pump portion is expanded, and part (b) of FIG. 4 shows the same in which the pump portion is contracted.

Figure 5:
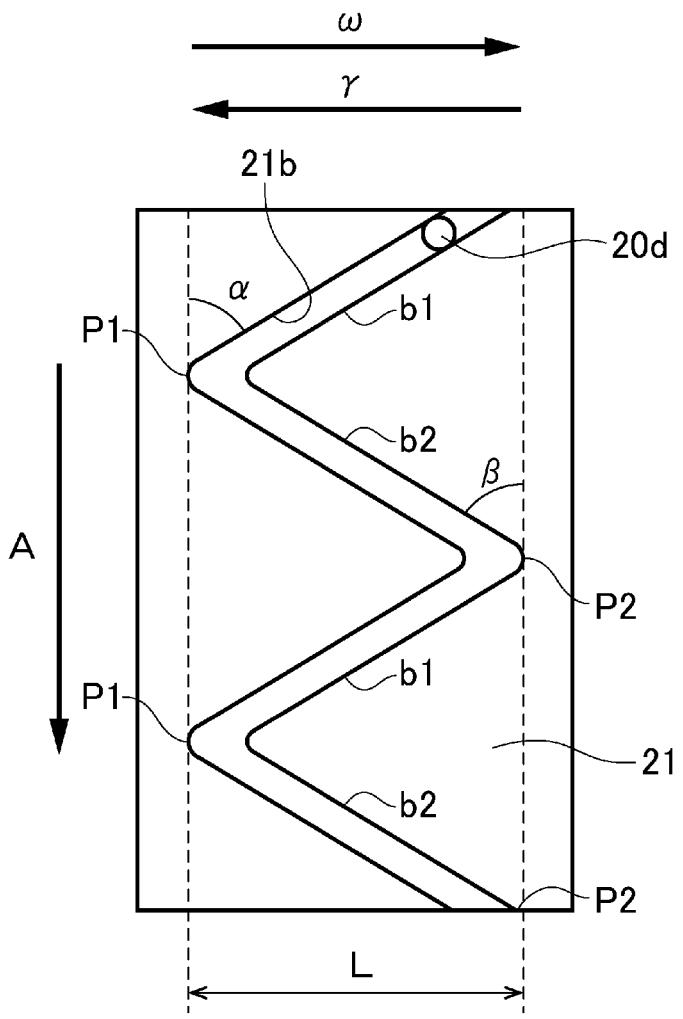

FIG. 5 is a development illustrating a structure of a cam mechanism of the toner bottle.

Figure 6:
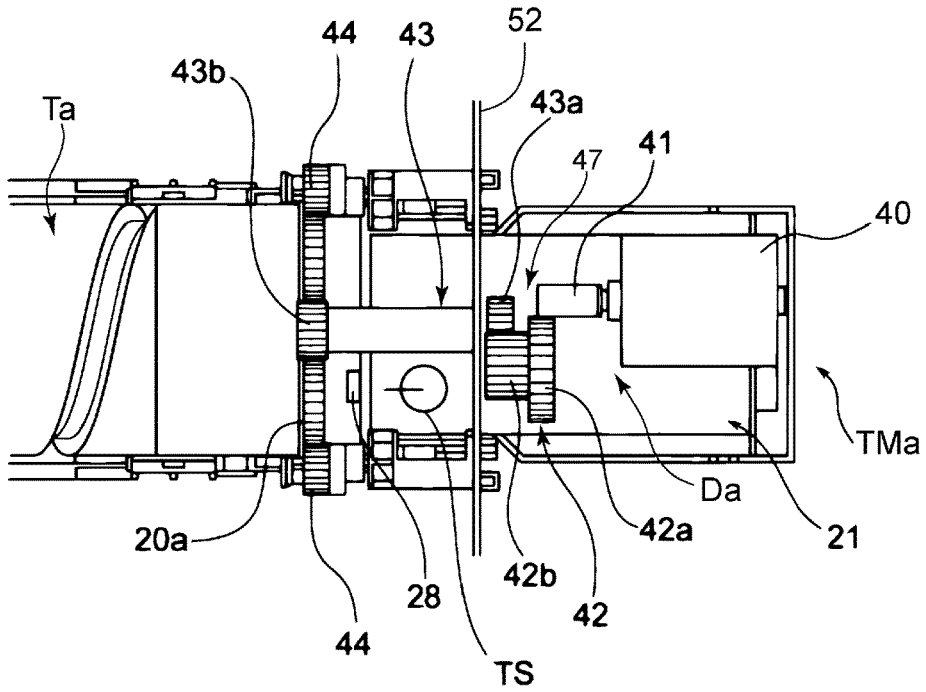

FIG. 6 is a top view of the mounting portion and the toner bottle mounted to the mounting portion.

Figure 7:
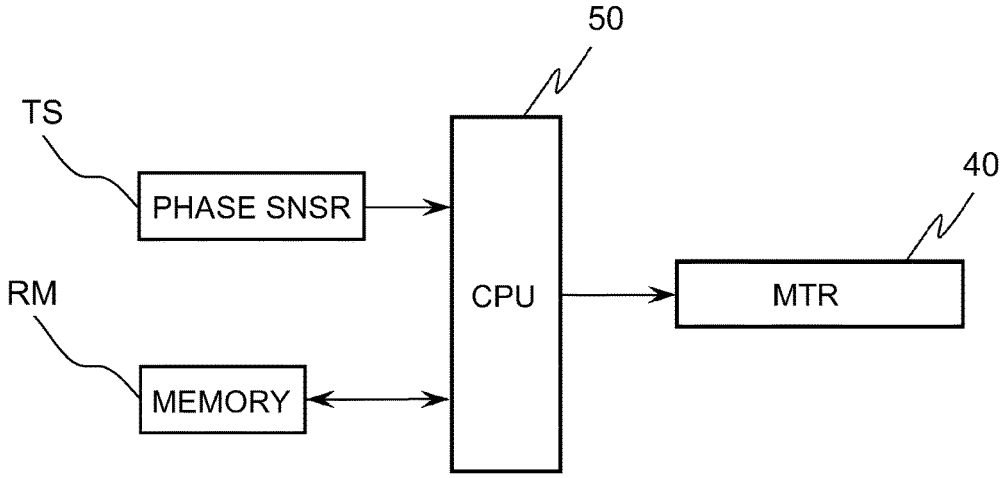

FIG. 7 is a block diagram illustrating a control structure of a driving motor.

Figure 8:
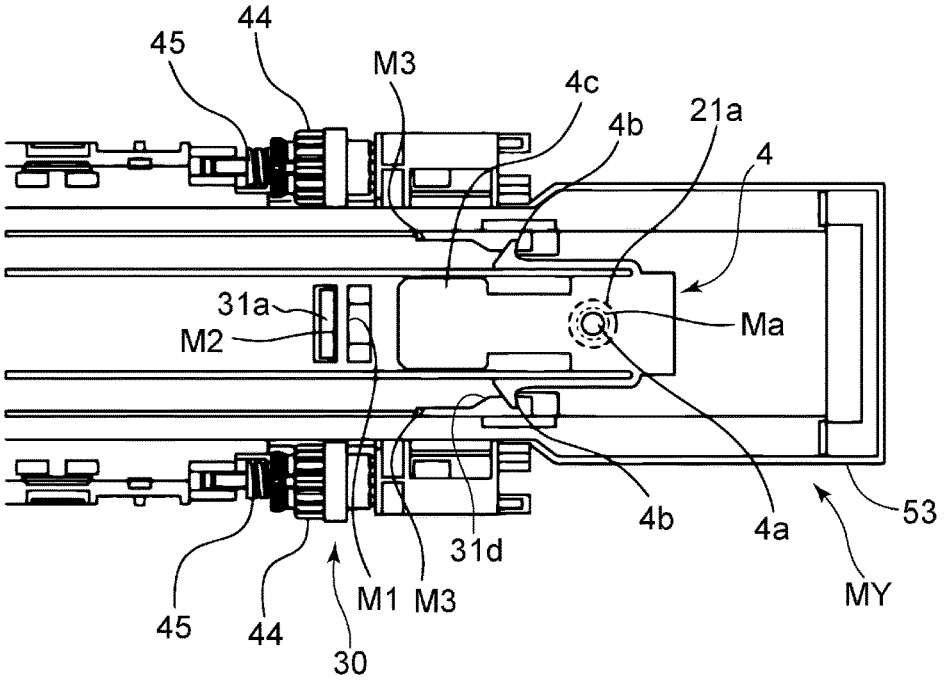

FIG. 8 is a top view illustrating a releasing device and a discharge opening shutter.

Figure 9:
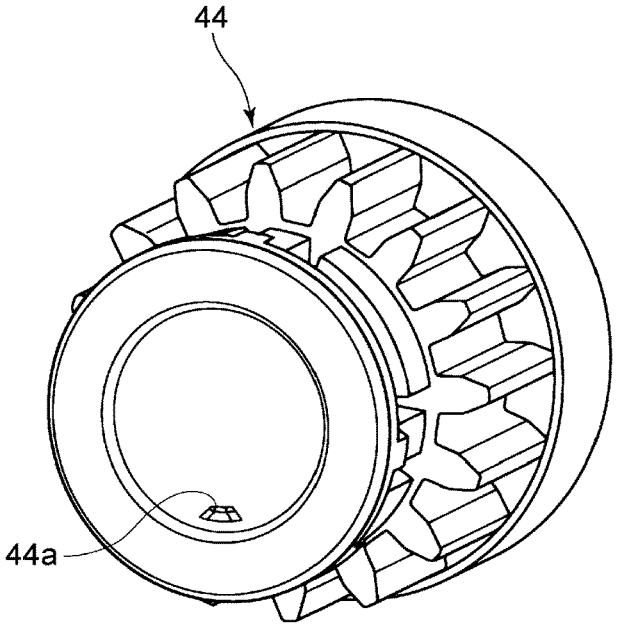

FIG. 9 is an illustration of a slide gear.

Figure 10:
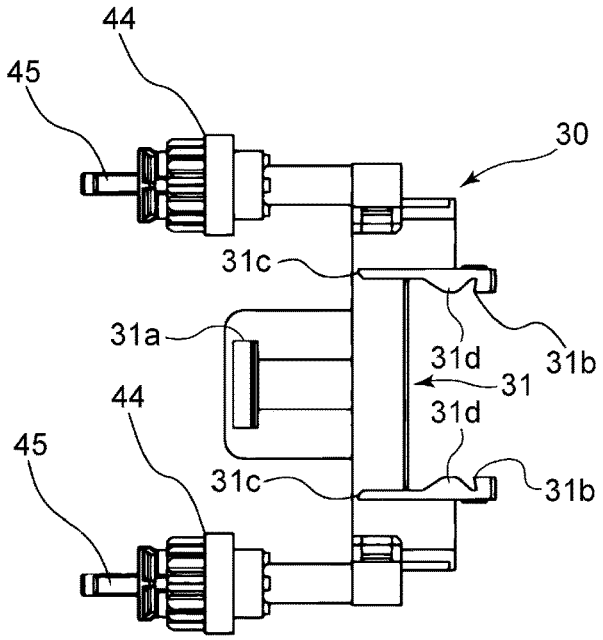
Figure 10:
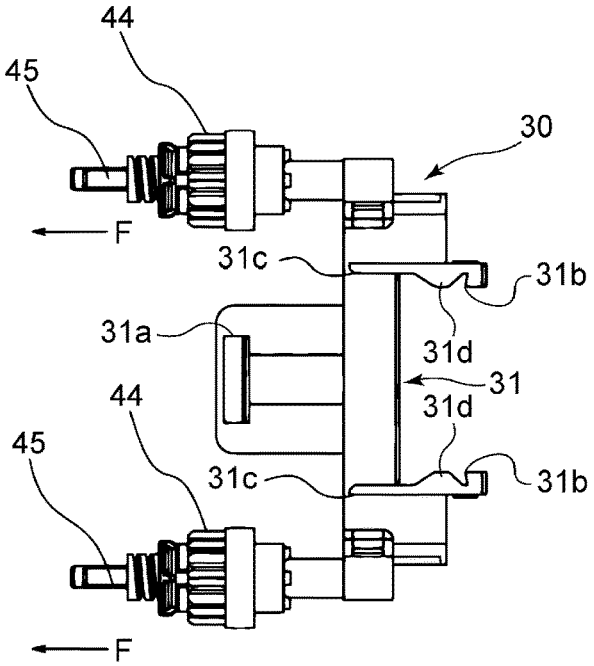

Part (a) of FIG. 10 is a top view of the releasing device in a stand-by state, part (b) of FIG. 10 shows the same in a released state.

Figure 11:
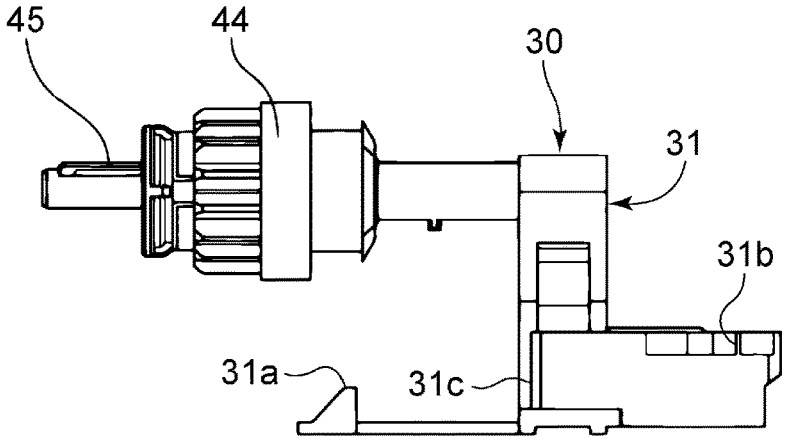
Figure 11:
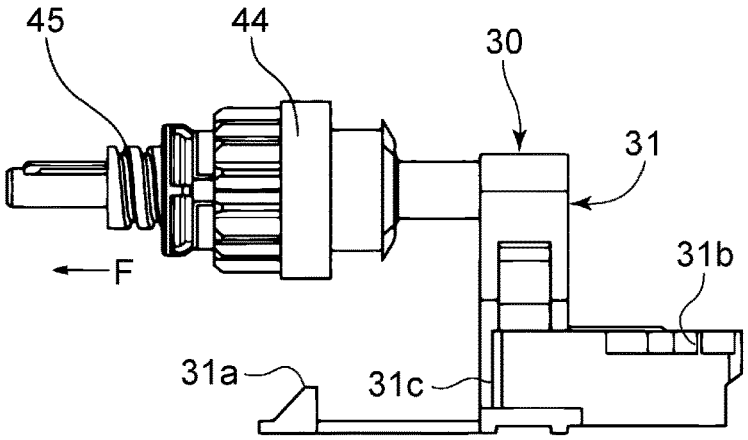

Part (a) of FIG. 11 is a sectional view of the releasing device in the stand-by state, part (b) of FIG. 11 shows the same in the released state.

Figure 12:
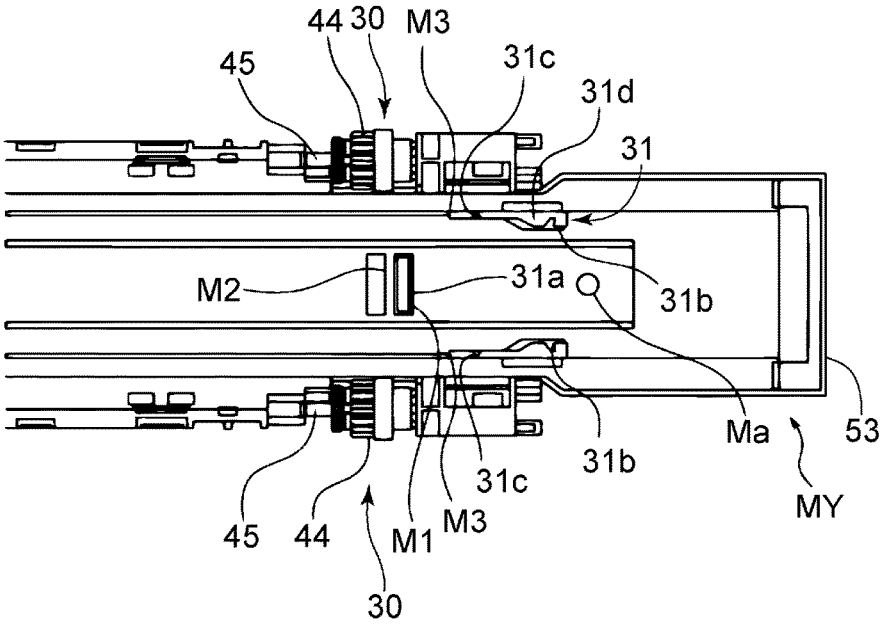
Figure 12:
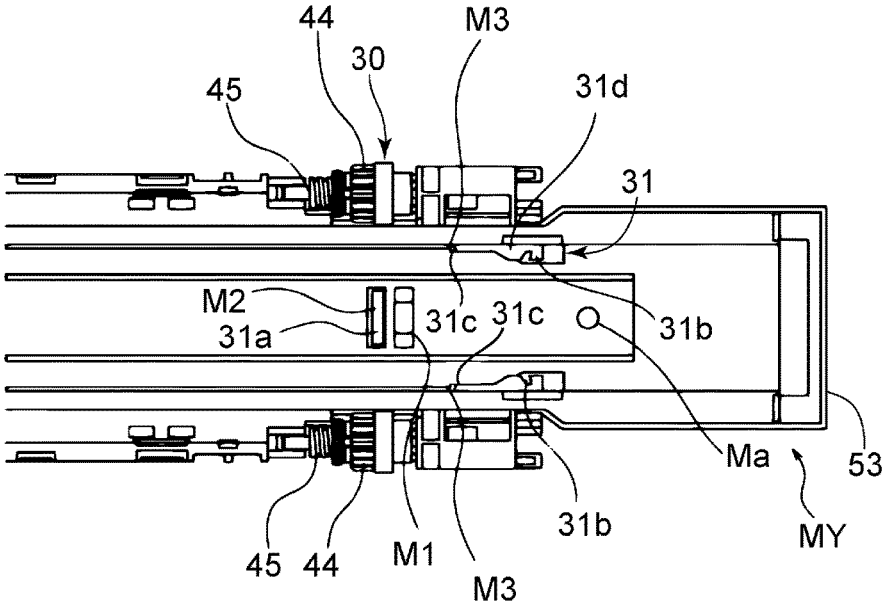

Part (a) of FIG. 12 is a top view of the releasing device and a holding member, part (b) of FIG. 12 shows the same in the released state.

Figure 13:
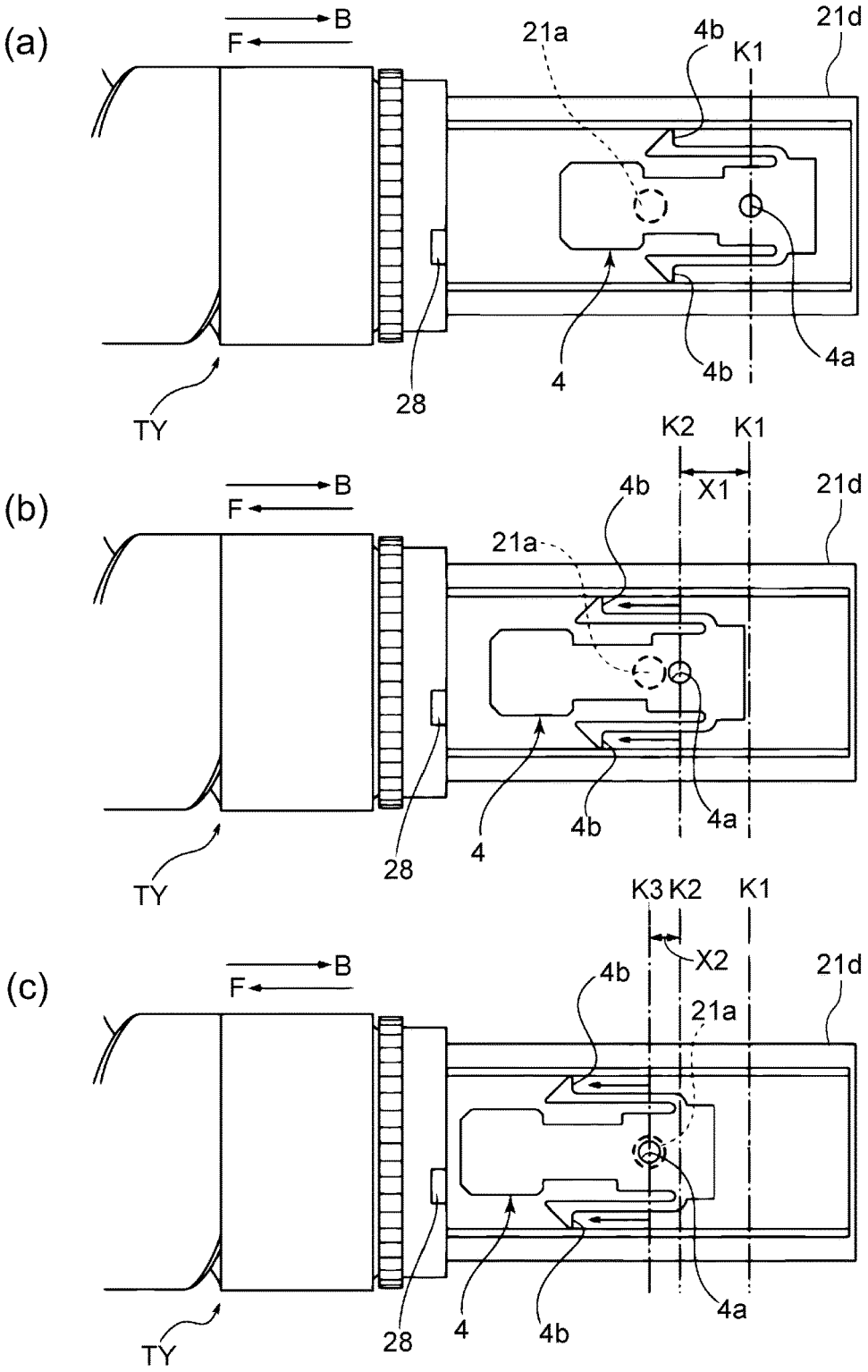

Part (a) of FIG. 13 shows a position of the discharge opening shutter at the time when the toner bottle is not mounted to the main assembly of the apparatus, part (b) of FIG. 13 shows a same at the time when the toner bottle is mounted in the main assembly with a discharge opening thereof sealed, and part (c) of FIG. 13 shows a same at the time when the toner bottle is mounted in the main assembly with a discharge opening unsealed.

Figure 14:
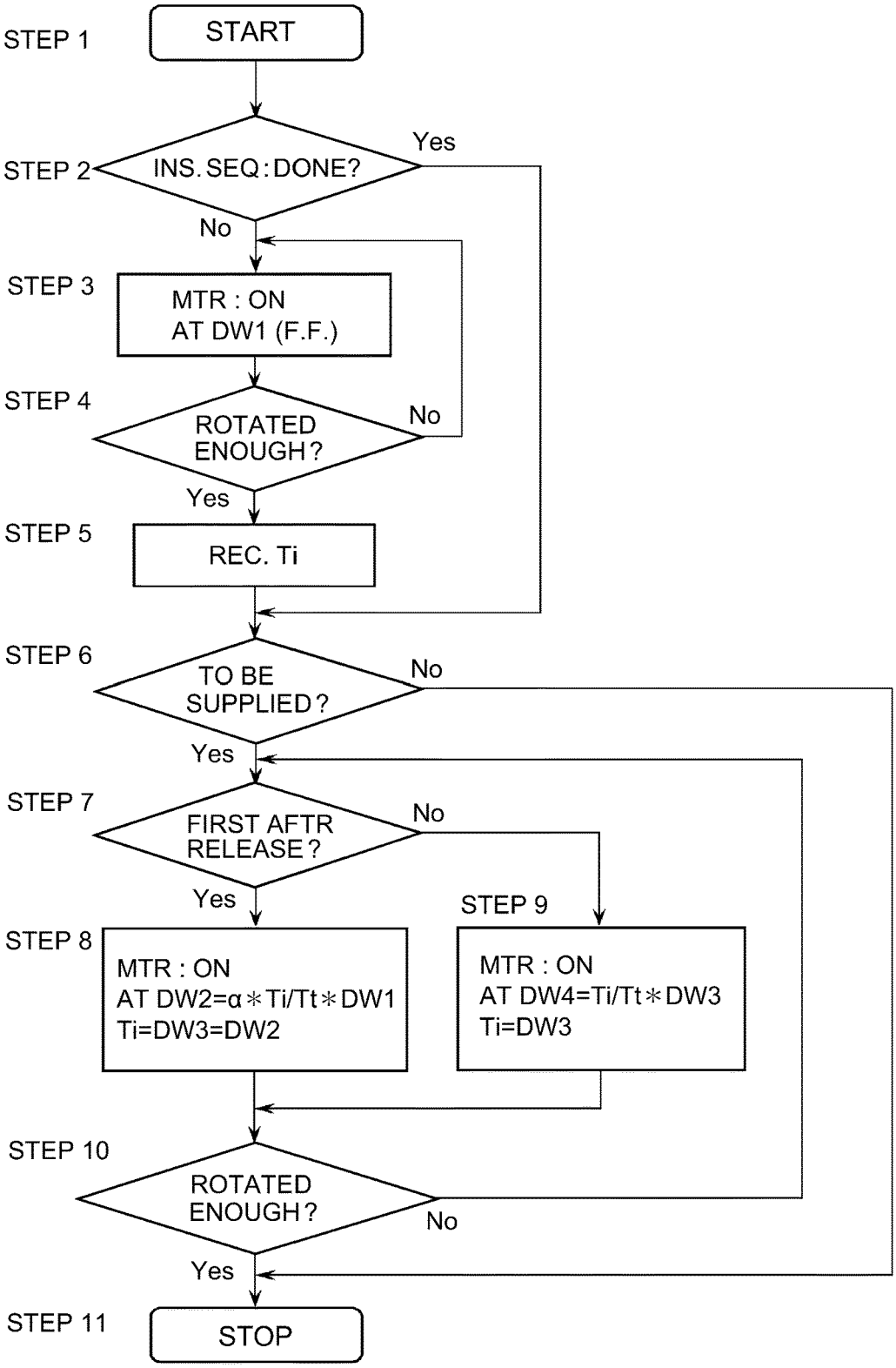

FIG. 14 is a flow chart showing an operation control flow for the toner bottle.

DESCRIPTION OF THE EMBODIMENTS

An image forming apparatus 100 according to an embodiment of the present invention will be described in conjunction with the accompanying drawings. In the image forming apparatus 100, a rear side is a downstream side of the inserting direction of a toner bottle TY-TK (rear side of the sheet of the drawing of FIG. 1), and a front side is the opposite side (front side of the sheet of the drawing of FIG. 1). Up, down, left and right of members are based on the directed toward the rear side.

[Image Forming Apparatus]

Figure 1:
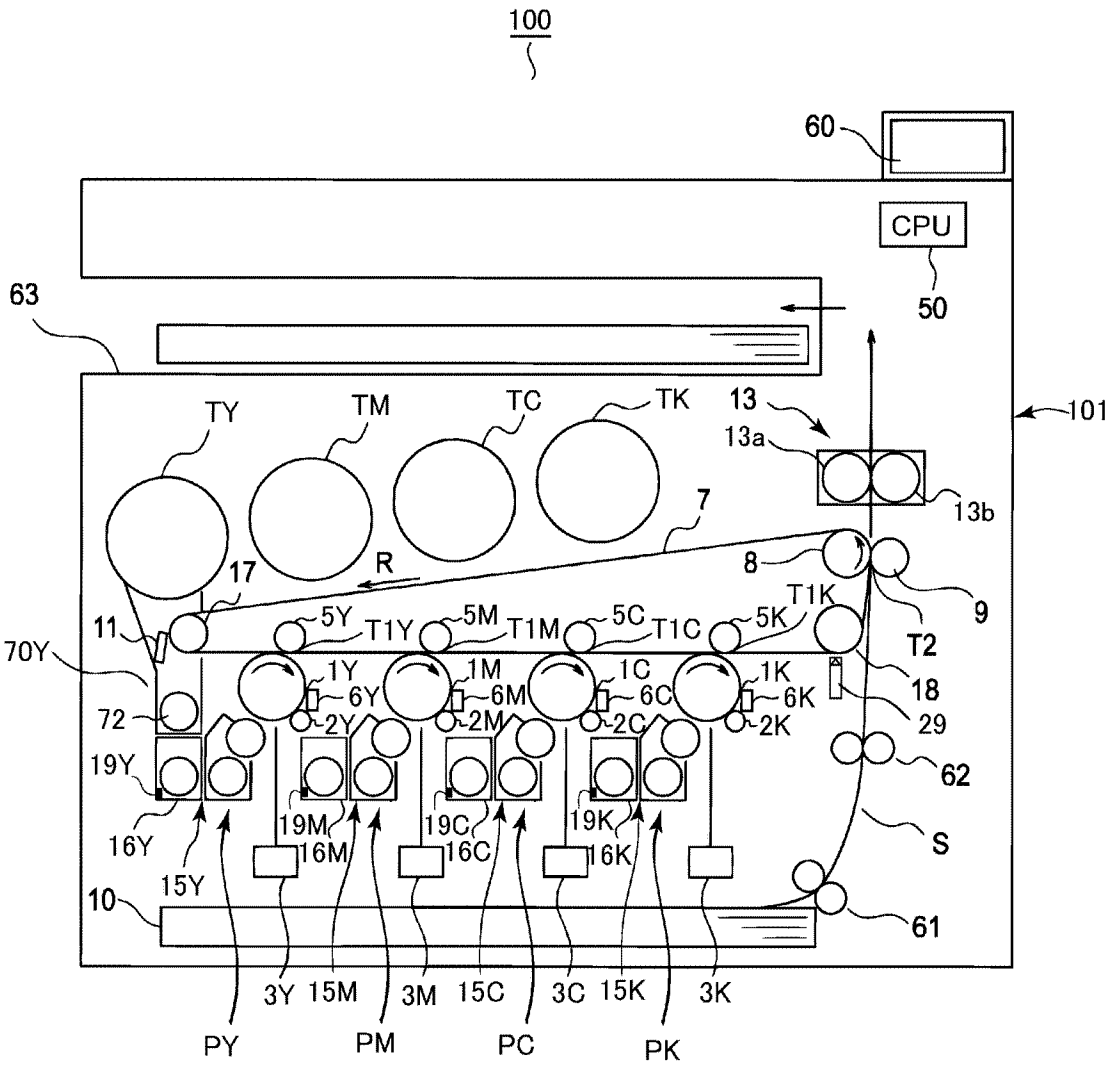
FIG. 1 is a schematic illustration of an image forming apparatus according to an embodiment of the present invention.

As shown in FIG. 1, the image forming apparatus 100 is a so-called intermediary transfer and tandem type color image forming apparatus comprising four image forming stations PY, PM, PC, PK for forming toner images using electrophotographic type process, the image forming stations PY, PM, PC, PK being arranged along an intermediary transfer belt 7. The image forming stations PY, PM, PC, PK form yellow (Y), cyan (M), magenta (C) and black (K) toner color images, respectively. Main assembly 101 of the image forming apparatus 100 comprises, in addition to the image forming stations PY, PM, PC, PK and the intermediary transfer belt 7, a storage 10, feeding rollers 61, registration rollers 62, a secondary transfer portion T2, a fixing device 13, A sheet discharge tray 63 a CPU50 and so on. Toner bottles TY, TM, TC and TK accommodating the toner having the colors corresponding to the image forming stations PY, PM, PC and PK are detachably mountable to the main assembly 101.

In the storage 10, recording materials S (sheet materials such as printer sheets, OHP sheet) are stacked. The feeding rollers 61 constitutes a pair of rollers of a friction separating type and function to single out and feed the recording material S to the registration rollers 62 in response to the operation of the image forming process which will be described hereinafter. The registration rollers 62 function to correct inclination of the recording material S and feed the recording material S to the secondary transfer portion T2 in timed relation with transfer of the toner image in the secondary transfer portion T2.

The secondary transfer portion T2 is formed as a nip between the intermediary transfer belt 7 extended around an inner roller 8 and an outer roller 9. To the inner roller 8 and the outer roller 9 in the secondary-transfer portion, a predetermined pressure and an electrostatic load bias are applied. The secondary transfer portion T2 nips the recording material S fed from the registration rollers 62 and transfers (secondary-transfer) the toner image from the intermediary transfer belt 7 to the recording material S by the pressure and the electrostatic load bias voltage.

The fixing device 13 includes a pair of fixing rollers 13*a* and 13*b*, urging means for applying a pressure in a nip formed between the fixing rollers 13*a* and 13*b*, and a heater (heat source) for applying a heat quantity to the toner image on the recording material S. The fixing rollers 13*a*, 13*b* are controlled in the temperature thereof in accordance with the progress of the image forming process, and when the recording material S having passed through the secondary transfer portion T2 is nipped by the rollers of the fixing device 13, the toner image is melted and is fixed on the recording material S. The recording material S now having the image is discharged onto the sheet discharge tray 63 in the case of the one-side printing, or is re-fed to the secondary transfer portion T2 through a reversion feeding device (unshown) and is subjected to the image forming operation on the back side thereof in the case of the both side printing.

[Image Forming Station]

Referring to FIG. 1, the description will be made as to the structure of the image forming stations PY, PM, PC and PK and the formation of the toner image (image forming process) by the image forming stations PY, PM, PC and PK. The image forming stations PY, PM, PC, PK are disposed in this order along the feeding direction of the intermediary transfer belt 7 (arrow R). However, the number of the colors and the order of the arrangement of the image forming stations are not limited to this example.

In the following description, the image forming station PY (yellow) will be described, and the description applies to the other image forming stations except for the color of the toner. As to the other color image forming stations, the description is applied by adding the reference numerals "M", "C" or "K" in place of "Y" to the elements for the magenta, cyan and black image forming stations.

The image forming station PY includes a photosensitive drum 1Y, a charging device 2Y, an exposure device 3Y, a developing device 15Y, a primary transfer roller 5Y and a photosensitive member cleaner 6Y and so on. The image forming station PY starts the image forming process operations in response to image formation instructions and image information produced by the CPU50 of the main assembly 101.

The photosensitive drum 1Y as the image bearing member is rotated along the feeding direction (R) of the intermediary transfer belt 7 by a developing drive device so that the surface thereof is uniformly charged by the charging device 2Y. To the photosensitive drum 1Y, a laser beam is projected from the exposure device 3Y in accordance with the image information by way of deflecting means, so that the electric charge of the surface of the photosensitive drum 1Y is selectively discharged by the laser beam, by which an electrostatic latent image is formed.

The developing device 15Y includes a developing container 16Y for accommodating a developer comprising toner and a rotatable developing sleeve for carrying the developer. Between the developing sleeve and the photosensitive drum 1Y, a developing bias voltage electric field is formed, by which the toner of the developer carried on the developing sleeve is electrostatically urged to move to the surface of the photosensitive drum 1Y, so that the electrostatic latent image is visualized (developed) into a yellow toner image. Inside the developing container 16Y, there is provided a toner content sensor 19Y as a toner content detecting means capable of detecting a toner content (weight ratio T/D of the toner to the developer) of the developer accommodated in the developing container 16Y.

Here, the developer in this embodiment is a two component developer comprising magnetic carrier particles and non-magnetic toner particles. The developing device 15Y in the initial state contains an initial developer comprising the carrier and the yellow toner which are mixed at a predetermined ratio, and the toner bottle TY is sealed in this state. The developer may contain a one component developer comprising only magnetic toner particles or non-magnetic toner particles. In addition, the toner bottle may contain a component other than the toner, for example, the toner bottle may contain a toner-rich mixture of the toner and the carrier of a predetermined toner rich ratio.

The primary transfer roller 5Y is opposed to the photosensitive drum 1Y through the intermediary transfer belt 7 to form a primary transfer portion T1Y as a nip. The toner image carried on the photosensitive drum 1Y is transferred onto the intermediary transfer belt 7 by the pressure and the electrostatic load bias voltage applied to the primary transfer portion T1Y by the primary transfer roller 5Y, so that the toner image is primary-transferred onto the intermediary transfer belt 7. Untransferred toner remaining on the photosensitive drum 1Y after passing through the primary transfer portion T1Y is removed by the photosensitive member cleaner 6Y, so that the surface of the photosensitive drum 1Y having passed the photosensitive member cleaner 6Y is in the state capable of being charged electrically, again.

The intermediary transfer belt 7 as an intermediary transfer member is an endless belt supported by an unshown belt frame and is extended around the inner roller 8, a tension roller 17 and an upstream roller 18. The inner roller 8 functions also as a drive transmitting means for the intermediary transfer belt 7 and is driven by a driving means (unshown) to drive the intermediary transfer belt 7 in the direction indicated by an arrow R.

The image forming process is carried out also in the other image forming stations PM, PC, PK, so that magenta, cyan and black toner images are formed on the photosensitive drums 1M, 1C and 1K, respectively. The toner images are transferred in alignment with the yellow toner image in the primary transfer portions T1M, T1C and T1K, so that a full-color toner image is formed on the surface of the intermediary transfer belt 7. From the intermediary transfer belt 7, the full-color toner image is transferred onto the recording material S in the secondary transfer portion T2.

Downstream of the primary transfer portion T1K, there is provided an optical density detecting sensor 29 as a density detecting means capable of detecting a density of a toner patch image transferred onto the surface of the intermediary transfer belt 7. The untransferred toner remaining on the intermediary transfer belt 7 having passed through the secondary transfer portion T2 is removed by a transfer cleaning device 11. The surface of the intermediary transfer belt 7 having passed the transfer cleaning device 11 is capable of carrying the toner image, again.

[Toner Bottle]

The description will be made as to the toner bottles TY, TM, TC, TK as accommodating containers for accommodating the developers. The description will be made with respect to the toner bottle TY accommodating the yellow toner, but the description applies to the other toner bottles TM, TC and TK by replacing the suffix "Y" with "M", "C" or "K".

Figure 2:
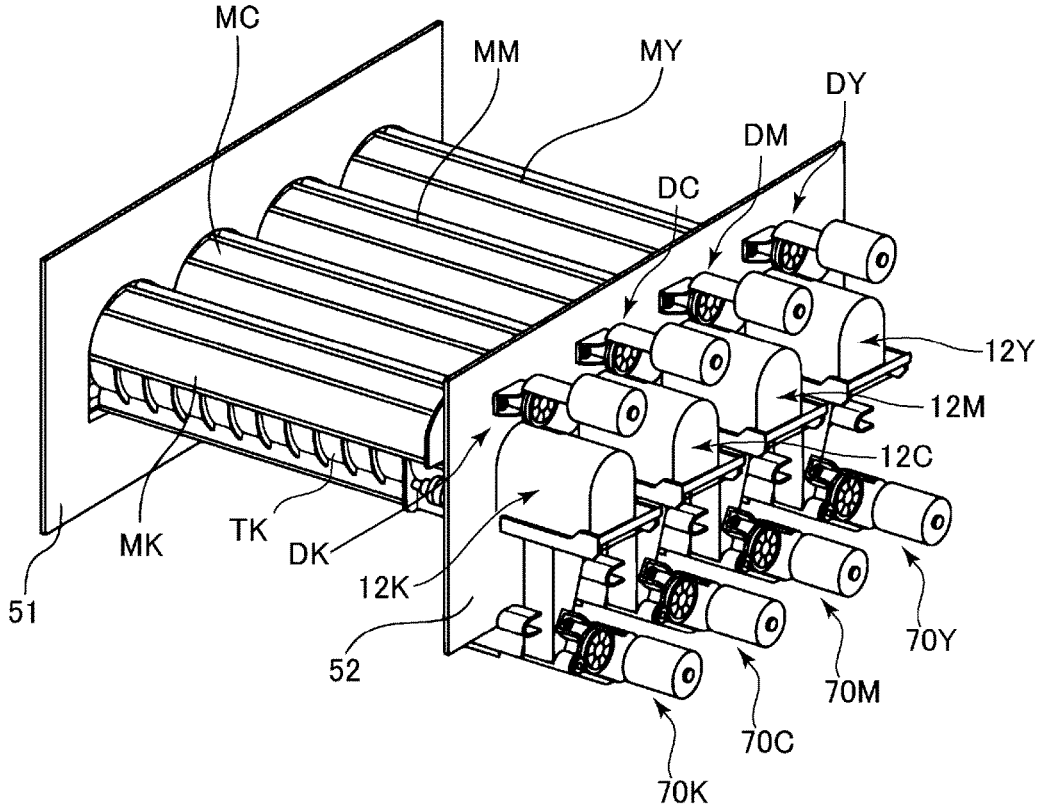
FIG. 2 is a perspective view of an inside of the image forming apparatus.
Figure 3:
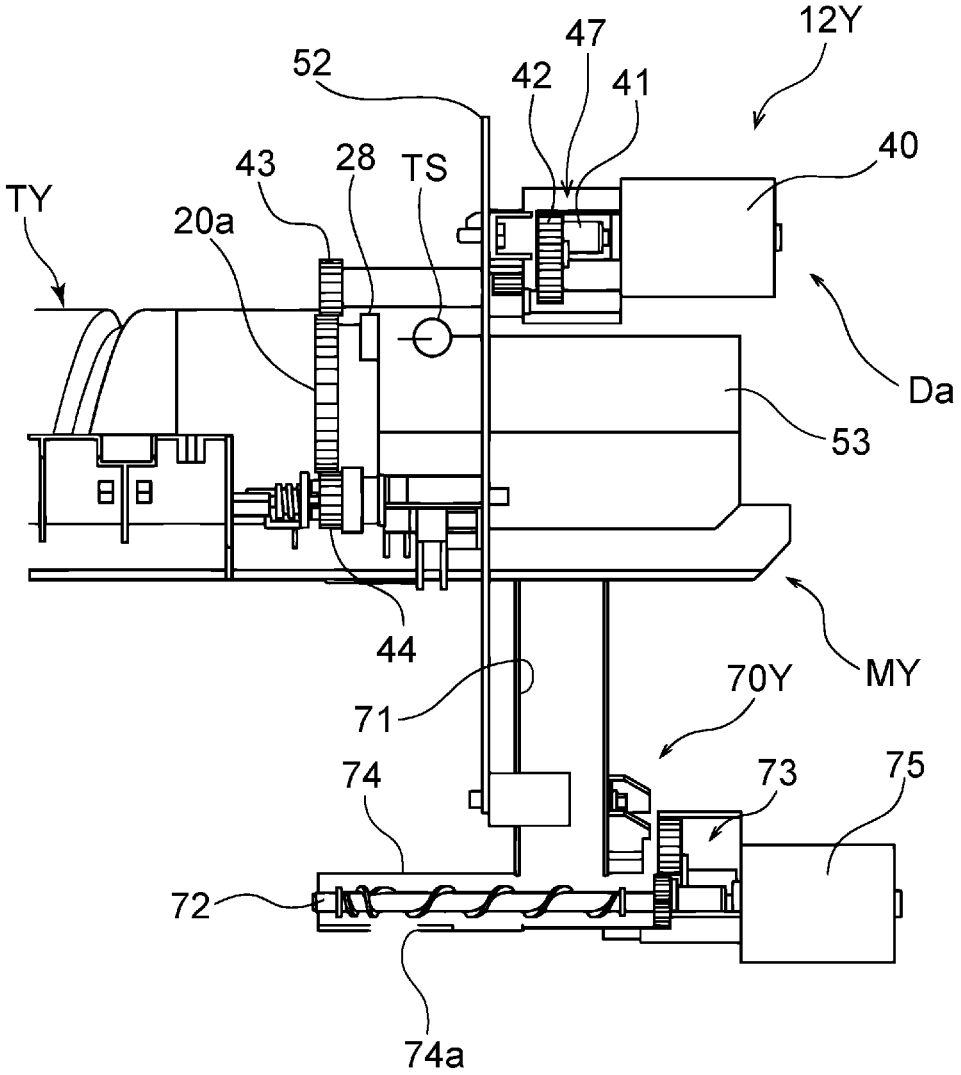
FIG. 3 is an illustration of a structure of a supplying device and a mounting portion.

As shown in FIGS. 2 and 3 the toner bottle TY is inserted from the front side to the rear side of the main assembly 101 to be mounted to the mounting portion 12Y of the main assembly 101. The mounting portion 12Y includes a holding member MY for holding the toner bottle TY, a driving portion DY for driving the toner bottle TY, and a supplying device 70Y for supplying the developing device 15Y with the toner discharged from the toner bottle TY. The details of the driving portion DY and the supplying device 70Y will be described hereinafter.

The holding member MY is extended from a front side supporting plate 51 provided standing at a front side of the main assembly 101 to a rear side supporting plate 52 provided standing at a rear side. The holding member MY is provided with a fixing portion 53 (FIG. 3) for non-rotatably holding the lower portion of the cap portion 21 of the toner bottle TY which will be described hereinafter. The four holding members MY, MM, MC and MK are independently supported by the front side supporting plate 51 and the rear side supporting plate 52.

As shown in FIG. 4, the toner bottle TY is provided with a hollow cylindrical bottle portion 20, a cap portion 21 (flange portion) at one axial end portion of the bottle portion 20, and a discharge opening shutter 4 in the cap portion 21. In the following description, a head portion side is the side of the bottle portion 20 provided with the cap portion 21, and a trunk side is the axially opposite side.

The cap portion 21 is provided with a hollow discharging portion 21*h* closed at one end of the head portion, and a bottom plate 21*c* which constitutes a bottom portion of the discharging portion 21*h* is provided with a discharge opening 21*a*. Below the bottom plate 21*c*, there is provided a bottom portion cover 21*d* which constitutes a bottom surface of the cap portion 21, and the discharge opening shutter 4 is disposed in the space between the bottom plate 21*c* and the bottom portion cover 21*d*. The bottom portion cover 21*d* has a rotation preventing shape (rectangular cross-section, for example) non-rotatably engaged with the fixing portion 53 on the toner bottle TY is held by the holding member MY. The discharge opening shutter 4 as an openable member disposed between the bottom plate 21*c* of the cap portion 21 and the bottom portion cover 21*d* with respect to the vertical direction, and is slidable in the axial direction of the bottle portion 20 between the opening position for opening the discharge opening 21*a* and a closing position for closing the discharge opening 21*a*. The toner bottle TY is constituted such that the toner is discharged through the discharge opening 21*a* by rotation of the bottle portion 20 when the discharge opening shutter 4 is in the open position.

The bottle portion 20 comprises a cylindrical portion 20*k*, a pump portion 20*b* and a gear portion 20*a*. The cylindrical portion 20*k* which is an example of the accommodating portion is cylindrical with the trunk side and closed to define an inside space capable of accommodating the toner (stippled portion in FIG. 4). The cylindrical portion 20*k* is provided with a helical projection 20*c* projected radially inwardly, so that the toner is fed toward the head portion by the rotation thereof.

The pump portion 20*b* is a bellows type displacement type pump (bellow-like pump), and is disposed adjacent to the head portion of the cylindrical portion 20*k* with an expanding and contracting direction thereof being the rotational axis direction of the cylindrical portion 20*k*. The pump portion 20*b* is made of elastically deformable resin material formed into bellows including alternating crest portions and bottom portions, and is contractable and expandable in the rotational axis direction.

The gear portion 20*a* is an annular gear having an outer bear teeth at a position adjacent to the head portion of the pump portion 20*b*. The gear portion 20*a*, the pump portion 20*b* and the cylindrical portion 20*k* of the bottle portion 20 are integrally formed and inserted to the cap portion 21 at the gear portion 20*a* side. The gear teeth of the gear portion 20*a* are exposed outwardly of the cap portion 21, and the bottle portion 20 rotates relative to the cap portion 21 by a driving force applied to the gear portion 20*a* from the driving portion DY. The gear portion 20*a* is urged to the cap portion 21 through a ring-like sealing member 27 at the head portion side thereof, and is limited in the movement toward the trunk side by the cap portion 21. The sealing member 27 is compressed between the gear portion 20*a* and the cap portion 21 to hermetically seal between the bottle portion 20 and the cap portion 21.

Between the cap portion 21 and the bottle portion 20, a cam mechanism 22 is provided to convert the rotational driving force transmitted to the gear portion 20*a* into a motion in the expansion and contracting direction (axial direction) of the pump portion 20*b*. The cam mechanism 22 includes a cam projection 20*d* on an outer peripheral surface of the cylindrical portion 20*k* of the bottle portion 20, and a cam groove 21*b* formed in the inner surface of the cap portion 21.

As shown in FIG. 5 (development view), the cam groove 21*b* includes a first inclined portion b1 inclined toward the head portion side and a second inclined portion b2 inclined toward the drum member portion side, as seen in the moving direction (arrow A) of the cam projection 20*d* caused by the rotation of the bottle portion 20. In this embodiment, the cam groove 21*b* includes two first inclined portions b1 and two second inclined portions b2 which connect two maximum contraction points P1 and P1 closest to the head portion side and maximum expanded points P2 and P2 closest to the trunk side with each other, as shown in FIG. 5. An inclination angle α of the first inclined portion b1 and an inclination angle β of the second inclined portion b2 relative to the circumferential direction are the same, in this embodiment. The structures of the cam mechanism 22 are not limited to this example, and the expansion-and-contraction speed and/or the expansion and contraction stroke or the like of the pump portion relative to the rotation of the bottle portion 20 can be adjusted by changing the configuration (values of the angles α, β and/or amplitude L of the cam groove) of the cam groove 21*b*, for example.

The cam projection 20*d* moves in the circumferential direction with the rotation of the bottle portion 20, and reciprocates in the axial direction along the first inclined portion b1 and the second inclined portion b2. Referring to FIGS. 4 and 5, when the cam projection 20*d* moved toward the head portion (arrow γ) along the first inclined portion b1, the cylindrical portion 20*k* moves toward the head portion relative to the cap portion 21, and the pump portion 20*b* contracts. On the other hand, when the cam projection 20*d* moves toward the trunk (arrow ω) along the second inclined portion b2, the cylindrical portion 20*k* moves toward the trunk, and the pump portion 20*b* expands. Because of the above-described configuration of the cam groove 21*b*, the cam projection 20*d* reciprocates twice and the pump portion 20*b* contracts and expands twice, by one full rotation of the bottle portion 20.

[Driving Device and Supplying Device]

The description will be made as to the driving portion DY of the mounting portion 12Y and the supplying device 70Y. As shown in FIG. 6, the driving portion DY includes a driving motor 40 as the driving device and a gear train 47, and is supported on the rear side supporting plate 52. The driving motor 40 is a DC motor and is controlled by a CPU50 of the main assembly 101. The driving motor 40 is disposed on the rear side supporting plate 52 with an output shaft thereof provided with an output gear 41 facing toward the front side.

The rotation of the output gear 41 is transmitted to the gear portion 20*a* of the toner bottle TY through the gear train 47 including a deceleration gear 42 and a connection gear 43. The deceleration gear 42 includes integral large diameter gear 42*a* and small diameter gear 42*b*, the large diameter gear 42*a* having a diameter larger than that of the output gear 41 in meshing engagement therewith, and the small diameter gear 42*b* having a diameter smaller than that of the large diameter gear 42*a*, so that the deceleration gear 42 transmits the rotation of the output gear 41 to the connection gear 43 with a reduced speed. The connection gear 43 integrally includes a gear 43*a* in meshing engagement with the small diameter gear 42*b* and a gear 43*b* in meshing engagement with the gear portion 20*a* of the toner bottle TY, and penetrates the rear side supporting plate 52.

As shown in FIG. 3, the supplying device 70Y comprises an accommodating portion 71, a feeding screw 72, a feeding motor 75, a gear train 73 and so on, and is disposed above the developing container 16Y and below the holding member MY (FIG. 1).

The accommodating portion 71 is cylindrical and extends in the vertical direction, and is disposed below the discharge opening 21*a* in the state that the toner bottle TY is mounted to the holding member MY. The bottom portion of the accommodating portion 71 is connected with a feeding portion 74 extending in the direction from the rear side to the front side, and to the front side lower portion of the feeding portion 74 a discharge opening 74*a* connected with the supply opening (unshown) of the developing container 16Y. Inside the feeding portion 74, there is provided a feeding screw 72 capable of feeding the toner from the rear side toward the front side and is rotated by a driving force received through the gear train 73 from the feeding motor 75 disposed in the rear side of the feeding portion. The feeding motor 75 is controlled by the CPU50 so as to be rotated in synchronism with the rotation of the development motor (unshown) for driving the developing sleeve, the stirring and feeding screw and so on. By this, the toner discharged from the toner bottle TY through the discharge opening 21*a* is fed by the feeding screw 72 to be supplied into the developing container 16Y.

[Control Structure for Toner Bottle]

The description will be made as to a control structure for controlling a discharging operation for discharging the toner from the toner bottle TY. As shown in FIGS. 3 and 6, the holding member MY is provided with a phase sensor TS in the form of a magnetometric sensor, for example, as a detecting means capable of detecting a rotational phase of the toner bottle TY. The toner bottle TY is provided with a phase flag 28 integrally rotatable with the bottle portion 20. In this embodiment, the phase flag 28 is provided at each of two positions diametrically opposite with respect to the rotational axis of the bottle portion 20 (180° difference in the phase). When the phase flag 28 approaches the phase sensor TS closely beyond a predetermined detected distance, the phase sensor TS is rendered ON, and otherwise, it is rendered OFF.

More particularly, the phase flag 28 is disposed such that when the cam projection 20*d* of the bottle portion 20 is at the maximum contraction point P1 (FIG. 5) of the cam groove 21*b*, the phase flag 28 is closest to the phase sensor TS. Therefore, the phase sensor TS is rendered ON when the pump portion 20*b* of the toner bottle TY contracts, and is rendered OFF when the pump portion 20*b* expands. When the gear portion 20*a* makes one full-rotation from the state in which the phase sensor TS is in the ON state, the phase sensor produces OFF, ON, OFF signals in the order named, and then reduces ON signal.

As shown in a block diagram of FIG. 7, the signal produced by the phase sensor TS is transmitted to the CPU50 of the main assembly 101. The CPU50 controls the output (torque and rotational frequency) of the driving motor 40 by feeding the PWM (Pulse Width Modulation) signal to the driving motor 40. In addition, the CPU50 is capable of counting the time period (elapsed time) required for one expanding-and-contracting operation of the pump portion 20*b* on the basis of the clearance between ON signals from the phase sensor TS, and stores the required time period. In the discharging operation of the toner bottle TY, the CPU50 feed-back-controls the driving motor 40 at the predetermined target value (Tt) of the required time period. The control flow will be described in more detail together with a control flow at the time of installation.

[Toner Supply]

In the above-described image forming apparatus 100, the CPU50 feeds the signal to the driving motor 40 to discharge the toner from the toner bottle TY, thus supplying the toner into the developing device 15Y using the supplying device 70Y. In the following, the toner discharging operation from the toner bottle TY will be described. First, the discharge opening shutter 4 of the toner bottle TY is in the opening position.

When the CPU50 rotates the driving motor 40, the gear portion 20*a* is driven through the gear train 47 to rotate the bottle portion 20 of the toner bottle TY. Then, the toner accommodated in the cylindrical portion 20*k* is fed into the head portion by the helical projection 20*c*, and the rotational force applied to the bottle portion 20 from the driving motor 40 by the cam mechanism 22 is converted into the expansion and contraction motion of the pump portion 20*b*.

The pump portion 20*b* functions as a suction and discharging mechanism for alternately effecting the sucking operation and the discharging operation through the discharge opening 21*a* by the expanding-and-contracting operation. When the pump portion 20*b* contracts, the inside space of the toner bottle TY is compressed to increase the internal pressure beyond the external air pressure, so that the toner discharged through the discharge opening 21*a*. When the pump portion 20*b* expands, the internal pressure of the toner bottle TY is lower than the external air pressure, and the ambient air is sucked through the discharge opening 21*a*. The toner is discharged through the discharge opening 21*a* is fed by the feeding screw 72 and discharged through the discharge opening 74*a* into the developing container 16Y. The CPU50 determines a required toner supply amount, and rotates the toner bottle TY until the toner amount discharged from the toner bottle TY reaches the required supply amount.

[Releasing Device]

Referring to FIG. 8 through FIG. 11, the description will be made as to the details of the discharge opening shutter 4, and a releasing device 30 for unsealing the toner bottle TY by moving the discharge opening shutter 4. A part of the discharge opening shutter 4 is inside the toner bottle TY, but the members of the toner bottle TY other than the discharge opening shutter 4 are omitted for simplicity, in FIG. 8.

As shown in FIG. 8, the discharge opening shutter 4 includes a shutter plate 4*c* and hook portions 4*b* and 4*b*. The shutter plate 4*c* is a flat plate-like member capable of sealing the discharge opening 21*a* when the discharge opening shutter 4 is in the closing position. A communication port 4*a* is provided in the head portion side of the shutter plate 4*c* and is circular and has a diameter which is smaller than that of the discharge opening 21*a*, and it is in fluid communication with the discharge opening 21*a* of the toner bottle TY when the discharge opening shutter 4 is in the opening position. A hook portion 4*b* includes an arm extended from each of the lateral sides of the shutter plate 4*c* toward the trunk side, and a free end portion bent at the free end of the arm, and the hook portion 4*b* is exposed to the outside of the toner bottle TY in the lower portion of the cap portion 21.

As shown in FIGS. 8 and 10, the releasing device 30 as the moving mechanism for moving the discharge opening shutter 4 is mounted to the holding member MY and is disposed below the toner bottle TY mounted to the holding member MY. The releasing device 30 includes a slidable member 31 (FIG. 10) slidable in the state of being engaged with the discharge opening shutter, a slide gear 44 for receiving the driving force from the gear portion 20*a* and transmitting to the slidable member 31, and a worm gear 45. The bottom surface of the fixing portion 53 of the holding member MY is provided with an opening Ma which opens at a position corresponding to the discharge opening 21*a* of the toner bottle TY when it is mounted to the holding member MY.

The slide gear 44 is an outer tooth gear which is engaged with the gear portion 20*a* of the toner bottle TY when the toner bottle TY is mounted to the holding member MY, and is disposed such that the slide gear 44 is overlapped with the gear portion 20*a* and the gear 43*b* of the connection gear 43 (FIGS. 3 and 6). The worm gear 45 is disposed inside the slide gear 44 and is supported by the slidable member 31.

A screw groove of the worm gear 45 is engaged with a projection 44*a* (FIG. 9) projected from an inner surface of the slide gear 44, and when the slide gear 44 rotates, the worm gear 45 slides toward the front side by the projection 44*a*. The length of the screw groove of the worm gear 45 is such that when an amount of rotation of the slide gear 44 reaches a predetermined amount, the worm gear 45 is disengaged from the projection 44*a*. Here, the predetermined amount is so selected that the movement distance in the axial direction of the worm gear 45 is sufficient to open and close the discharge opening 21*a* by the discharge opening shutter 4. In this embodiment, the worm gear 45 is designed such that the projection 44*a* is disengaged from the slide gear 44 when the gear portion 20*a* makes one half of the full rotation (180° rotation). That is, releasing device 30 is constituted such that the driving force transmission to the discharge opening shutter 4 is stopped after the discharge opening shutter 4 is moved from the closing position to the opening position.

As shown in FIGS. 10 and 11 the slidable member 31 is integral with a positioning claw portion 31*a*, a locking portion 31*b* engageable with the hook portion 4*b* of the discharge opening shutter 4, and a contact portion 31*c* contactable with the abutting portion M3 of the holding member MY which will be described hereinafter. Between the locking portion 31*b* and the contact portion 31*c*, there is provided a projected portion 31*d* which is projected into a trapezoidal configuration widthwisely inwardly of the discharge opening shutter 4. The slidable member 31 moves integrally with the worm gear 45. By this, the slidable member 31 is movable between a stand-by position (part (a) of FIG. 10 and part (a) of FIG. 11) corresponding to the closing position of the discharge opening shutter 4 and a release position (part (b) of FIG. 10 and part (b) of FIG. 11) corresponding to the opening position of the discharge opening shutter.

As shown in FIG. 12, the holding member MY is provided with a first locking portion M1, a second locking portion M2 and an abutting portion M3 as positioning portions for limiting the positions of the slidable member 31. The first locking portion M1 locks the portion 31*a* of the slidable member 31 which is placed in the stand-by position (part (a) of FIG. 12) to prevent the movement toward the rear side. The second locking portion M2 is disposed in front side of the first locking portion M1 and locks the portion 31*a* of the slidable member 31 which is placed in the release position (part (b) of FIG. 12) to prevent the movement toward the rear side. The abutting portion M3 is contactable with the contact portion 31*c* of the slidable member 31 to prevent the movement of the slidable member 31 toward the front side beyond the release position.

[Movement of Discharge Opening Shutter]

Referring to FIG. 13, the movement of the discharge opening shutter 4 to the opening position will be described. The first position K1, the second position K2 (closing position) and the third position K3 (opening position) of the discharge opening shutter 4 is based on the center of the position of the communication port 4*a*. When the toner bottle TY is not mounted in the main assembly 101, the discharge opening shutter 4 is in the first position K1 shown in part (a) of FIG. 13, for example. At this time, the discharge opening 21*a* of the toner bottle TY is sealed by the shutter plate 4*c*. In the melon, the releasing device 30 is in the stand-by state in which the slidable member 31 is in the stand-by position.

The operator inserts the toner bottle TY into the holding member MY in the rearward direction from the front side (arrow B). When the toner bottle TY is further inserted, the hook portion 4*b* is urged by the projected portion 31*d* and is moved toward the rear side of the projected portion 31*d* while elastically deforming inwardly, and is locked with the locking portion 31*b*. At this time, the slidable member 31 is locked by the first locking portion M1 in the stand-by position, and the rearward movement of the discharge opening shutter 4 is limited by the slidable member 31, and therefore, the discharge opening shutter 4 slides frontwardly with the insertion of the toner bottle TY. When the toner bottle TY is completely inserted, the discharge opening shutter 4 is in the position frontwardly away from the first position K1 by a movement distance X1, that is, the discharge opening shutter 4 is in the second position K2 (closing position) shown in part (b) of FIG. 13. At this time, the discharge opening 21*a* of the toner bottle TY and the opening Ma of the holding member MY are aligned with each other, and simultaneously, the discharge opening 21*a* is closed by the shutter plate 4*c* of the discharge opening shutter 4, and therefore, the toner bottle TY is kept sealed The phase flag 28 of the toner bottle TY is positioned such that when the toner bottle TY is inserted into the holding member MY, the phase sensor TS reduces an ON signal.

In accordance with a flow chart (FIG. 14) which will be described hereinafter, the gear portion 20*a* of the toner bottle TY by is rotated the driving motor 40 by the predetermined amount (half of full-rotation), by which the sealing of the toner bottle TY is released (releasing operation). That is, by the rotation of the gear portion 20*a*, the slidable member 31 is slid frontwardly by the way of the slide gear 44 and the worm gear 45. A claw portion 31*a* of the slidable member 31 disengages from the first locking portion M1 to move frontwardly. When the gear portion 20*a* rotates through one half, the phase sensor TS produces the ON signal, again, and then, the worm gear 45 disengages from the projection 44*a* of the slide gear 44. At this time, the slidable member 31 is in the release position, so that the claw portion 31*a* is engaged with the second locking portion M2 and the slidable member 31 stops.

By the released state in which the slidable member 31 of the releasing device 30 is in the release position, the discharge opening shutter 4 is pulled by the slidable member 31 to move from the second position K2 frontwardly by the distance of movement distance X2 to reach the third position K3 (opening position) shown in part (c) of FIG. 13. The movement distance X2 corresponds to the slide amount of the warm gear 45 by the slide gear 44, and is large as compared with a sum of a radius of the discharge opening 21*a* and a radius of the communication port 4*a*. By the alignment between the discharge opening 21*a* and the communication port 4*a* of the discharge opening shutter 4 placed in the third position K3, the inside of the toner bottle TY is brought into fluid communication with an outside through the communication port 4*a*. By this, the releasing operation of opening the discharge opening 21*a* and unsealing the toner bottle TY is completed, so that the toner bottle TY becomes capable of supplying the toner through the supplying device 70Y.

When the already unsealed toner bottle TY is exchanged, the operator grips the toner bottle TY and pull it frontwardly. Then, the hook portion 4*b* is urged by the projected portion 31*d* to elastically deform (FIG. 8), so that the discharge opening shutter 4 disengages from the releasing device 30 and is removed to the outside of the main assembly 101 together with the toner bottle TY. At this time, the slidable member 31 is prevented from moving frontwardly because the contact portion 31*c* abuts to the abutting portion M3. When a fresh toner bottle TY is inserted, the discharge opening shutter 4 is locked with the slidable member 31 placed in the release position, and therefore, a discharge opening shutter 4 slides frontwardly by a movement distance X1+X2. By this, the discharge opening shutter 4 is moved from the first position K1 directory to the third position K3, and the discharge opening 21*a* is unsealed by the inserting operation of the toner bottle TY.

[Operation Control for Toner Bottle]

Referring to FIG. 14 (flow chart), a control flow for the driving motor 40 using the CPU50, for operating the toner bottle TY. In the following, the description will be made as to the yellow toner bottle TY, but it applies to the other toner bottles TM, TC, TK except for the controlled object (driving motors for the driving portions DM, DC, DK) is different. The control flow operations are carried out using the program stored in memory medium of the main assembly 101 and read out into the memory RM by the CPU50.

The CPU50 starts the execution of the control flow (STEP1), when the voltage source of the main assembly 101 is rendered ON, or when the preceding image forming process is completed, and so on, and the first to the information in the memory RM to discriminate whether or not an installation sequence of the main assembly 101 is completed (STEP2). The installation sequence is a series of adjusting operations to be executed when the image forming apparatus 100 shipped from the plant is first supplied with the electric power.

The adjusting operation includes the releasing operation for the toner bottle TY, the light quantity adjustment for a density detecting sensor, and initialization of the developing device 15Y. The light quantity adjustment is an adjusting operation for the optical density detecting sensor 29, and for example, the adjustment is carried out such that a output of a detected received light quantity of the density detecting sensor 29 under a predetermined light quantity is a predetermined value. The initialization of the developing device includes a toner content adjustment of adjusting the toner content in the developing device 15Y by stirring the developer in the developing device 15Y, for example to make even the T/D ratio in the container. When the installation sequence is completed, installation information indicative of the completion of the installation sequence is written in the memory RM.

If the installation sequence has not yet been completed (STEP2: No), the CPU50 supplies to the driving motor 40 a signal (first initial input value) of a first duty ratio DW1 which has been preset and controls the driving motor 40 through a feed-forward control (STEP3). The first duty ratio DW1 is preset before the shipment of the apparatus such that a rotational speed in the STEP3 is a target rotational frequency N1=60 [rpm].

The CPU50 is responsive to the signal from the phase sensor TS to continue the drive of the driving motor 40 until the predetermined amount of rotation of the gear portion 20*a* corresponding to the predetermined number of pump operations (once in this embodiment) of the pump portion 20*b* (STEP4). By this, utilizing a part of the driving force applied to the toner bottle TY from the driving motor 40, the releasing device 30 moves the discharge opening shutter 4 from the closing position to the opening position, so that the unsealing of the toner bottle TY constituting a part of the installation sequence is automatically carried out. When the predetermined amount of rotation of the pump portion 20*b* is detected (STEP4: Yes), the driving motor 40 is stopped. At this time, a time period Ti required by one pump operation is stored in the memory RM by the CPU50 (STEP5), in the final one half rotation of the toner bottle TY in the STEP3 (final expanding-and-contracting operation of the pump portion 20*b*).

The rotation amount of the driving motor 40 required for the releasing operation of the releasing device 30 may be larger or smaller than the rotation amount corresponding to one pump operation of the pump portion 20*b*. In this embodiment, the driving motor 40 is rotated through the feed-forward control to effect the releasing operation of the releasing device 30, but the releasing operation may be effected through a feed-back control. In such a case, the CPU50 inputs the signal of the first duty ratio DW1 to the driving motor 40, and then the input signal to the driving motor 40 is corrected on the basis of the signal from the phase sensor TS so that the rotational speed of the toner bottle TY approaches to the target rotational frequency N1.

Then, the CPU50 discriminates the necessity of the toner supply on the basis of the deduction value of the toner consumption amount or the T/D ratio or the like in the developing container (STEP6). The CPU50 deduces the toner consumption amount by counting the video count from the image information, for example. Here, the video count is the value corresponding to an integration of density values of individual pixels of the image data for one image, for the color of the toner. The T/D ratio in the developing container is determined on the basis of the detected value or the like by the toner density sensor 19Y provided in the developing container 16Y, for example.

When the toner supply it is necessary, the CPU50 discriminates whether or not the toner supply is the first supply after the releasing operation of the releasing device 30 (STEP7). If it is the first supply (STEP7: Yes), the CPU50 inputs the second duty ratio DW2 signal (second initial input value) to the driving motor 40, and rotates the toner bottle TY by a rotation amount corresponding to one pump operation (STEP8). In addition, the CPU50 renews the time Ti required for one pump operation under the second duty ratio DW2, and writes the value of the second duty ratio DW2 in the memory RM as the previous duty ratio DW3.

The description will be made as to the difference of the torque load for the driving motor 40 between the releasing operation and the discharging operation. In the step (STEP3) in the case of the releasing operation, a load torque which is a sum of the load for rotating the toner bottle TY and the load for moving the discharge opening shutter 4 through the releasing device 30 is applied to the driving motor 40. On the other hand, in the step (STEP8) in the case of the supplying operation, the drive input to the discharge opening shutter 4 is shut off, so that the slide gear 44 of the releasing device 30 is rotatable without load. Therefore, the torque load applied to the driving motor 40 in the supplying operation (discharging operation) of STEP8 is small as compared with the torque load in the releasing operation (initial operation thereof) of STEP3.

In view of this, the second duty ratio DW2 which is the input value to the driving motor 40 in the initial supply after the releasing operation is determined using the above-described Ti and DW1, as follows:

$$DW2=\alpha\times(Ti/Tt)\times DW1 \quad (1)$$

Here, Tt is the target time of the time period required for one pump operation and is determined on the basis of the target rotational frequency N2 (predetermined speed) in the discharging operation. The target rotational frequency N2 in the discharging operation is set as being in the same as the target rotational frequency N1 in the releasing operation (N2=N1=60 rpm), and therefore, Tt=0.5 (sec). Value $\alpha$ is a constant smaller than 1, and $\alpha$=0.7 in this embodiment.

Value $\alpha$ is not limited to this example, and can be selected within the range of $0<\alpha<1$ in consideration of the difference in the torque load to the driving motor 40 between STEP3 and STEP8. It will suffice if the following inequality is satisfied when T1=T2 where T1 is the time period required for one pump operation in the previous operation of STEP8, and T2 is the time period required for one pump operation in the previous operation of STEP9:

$$(DW2/DW1)<(DW4/DW3) \quad (2)$$

From inequality (2), when the rotational speed of the gear portion 20*a* under the first duty ratio DW1 is lower than the target rotational frequency N1 (Ti>Tt), the value of the second duty ratio DW2 is set so as to be large as compared with a product of the coefficient $\alpha$ and the first duty ratio DW1. When the rotational speed of the gear portion 20*a* is higher as compared with the target rotational speed (Ti<Tt), the value of the second duty ratio DW2 is set so as to be small as compared with the product of the coefficient $\alpha$ and the first duty ratio DW1. When the time period required for one pump operation under the first duty ratio DW1 is not longer than the target value, the CPU50 corrects the second duty ratio DW2, by which the output torque of the driving motor 40 is larger than that when the required time period is larger than the target value. By doing so, the rotational speed at the time when the gear portion 20*a* is rotated in the initial discharging operation after the releasing operation is controlled so as to be closer to the target rotational frequency N2. Alternatively, the value of the second duty ratio DW2 in STEP8 may be preset at a predetermined value without depending on the toner bottle TY in the releasing operation.

If the supply is not the first one after the other releasing operation in STEP7 (STEP7: No), that is, in the second or subsequent supplying operation after the opening of the discharge opening 21*a*, the CPU50 proceeds to STEP9. In STEP9, the CPU50 determines the input value (duty ratio DW4 in the current operation) in the current supplying operation using the following equation (3), and drives the driving motor 40 with the rotation amount corresponding to one pump operation (STEP9):

$$DW4=Ti/Tt\times DW3 \quad (3).$$

From equation (3), when the rotational speed of the gear portion 20*a* under the previous duty ratio DW3 is lower as compared with the target rotational frequency N2 (Ti>Tt), the value of the current duty ratio DW4 is set to be larger than the previous duty ratio DW3 (DW4>DW3). When the rotational speed of the gear portion 20*a* is high as compared with the target rotational speed (Ti<Tt), the current duty ratio DW4 is set to be smaller than the previous duty ratio DW3 (DW4<DW3). In other words, the required time period per pump operation under the previous duty ratio DW3 is not more than the target value, the CPU50 controls the driving motor 40, by which the output torque is larger than that when the required time period is larger than the target value. By doing so, rotational speed when the gear portion 20*a* is rotated in the supplying operation is controlled so as to be closer to the target rotational frequency N2.

In STEP8 and STEP9, the CPU50 renews the required time period Ti for one pump operation on the basis of the detection signal of the phase sensor TS, and renew the current duty ratio (DW2 or DW4) by substituting it for the previous duty ratio DW3. The CPU50 counts the number of pump operations and discriminates whether or not the number reaches the supply number determined by the STEP6 (STEP10). The number of the pump operations is smaller, the operation returns to STEP7 in which the pump operation is repeated.

When the CPU50 detects that the number of the pump operations reaches the supply number of determined by the STEP6 (STEP10: Yes), The CPU50 finishes the control for the toner bottle TY (STEP11), and waits for the next control start.

In the installation sequence of the main assembly 101, the releasing operations for the toner bottles TY, TM, TC, TK are carried out after the light quantity adjustment. The unsealing operation for the toner bottles TY, TM, TC, TK are carried out after the initializing of the developing devices 15Y, 15M, 15C, 15K, respectively. The initializing operations are carried out in the order of the from yellow, magenta, cyan and black developing devices, and the releasing operations are also carried out in this order. At this time, the releasing operation for the toner bottle (toner bottle TY, for example) corresponding to the developing device for which the initializing operation has been completed is carried out concurrently with the initializing operation for the subsequent developing device (developing device 15M, for example).

[Effect of this Embodiment]

In the image forming apparatus 100 of this embodiment, the output of the driving motor 40 in the discharging operation (STEP7-STEP10) is feed-back controlled so that the rotational speed approaches to the target rotational frequency N2. By this, the amount of the toner discharge from the toner bottle TY per pump operation can be stabilized, and therefore, the toner can be stably supplied into the developing device. With such a structure, when the discharge opening is opened by moving the openable member using the driving device for rotating the accommodating container, it can be avoided that the rotation of the accommodating container is unstable after opening the openable member. The specific description will be made, taking the yellow toner bottle TY as an example.

First, as a comparison example, a structure in which CPU50 control the driving motor 40 through a series of feed-back control extending over the releasing operation and the supplying operation. That is, the CPU50 inputs a predetermined initial input value to the driving motor 40 and causes the releasing device 30 to move the discharge opening shutter 4 to the opening position, and then continuous the feed-back control without resetting the input signal to the driving motor 40. In this case, there is a liability that the rotational speed of the driving motor 40 significantly changes immediately after the discharge opening 21*a* is opened, due to the difference between the torque load applied to the driving motor 40 in the releasing operation and the torque load applied to the driving motor 40 in the supplying operation. Then, the time required until the rotational speed of the driving motor 40 converges to the target rotational frequency by the feed-back control is long with the result of unstable rotational speed of the toner bottle TY. When the variation in the developer amount discharged from the toner bottle TY is large, the toner content in the developing device significantly changes with the possible result of deterioration of the image quality.

On the other hand, in this embodiment, the releasing operation (initial operation thereof) is started and carried out using the signal (first initial input value) of the first duty ratio DW1, and then the supplying operation (discharging operation) is started using the signal (second initial input value) of the second duty ratio DW2 which is different from the first duty ratio DW1. Therefore, by setting the initial input value (DW1, DW2) depending on the difference in the torque load between the releasing operation and the supplying operation, the significant variation of the rotational speed of the toner bottle TY can be avoided at the time of shifting from the releasing operation to the supplying operation. By this, the toner bottle TY can be rotated at the speed close to the target rotational frequency N2 to provide a stabilized developer discharge amount, so that the necessary amount of the developer can be assuredly supplied into the developing device 15Y.

With this structure such as the comparison example structure in which the rotational speed of the toner bottle TY significantly changes, that is a liability that the frequency of the vibration of the toner bottle TY and the driving motor 40 overlaps a resonance frequency of a part (cartridge type image forming station PY, for example) of the main assembly 101. If this occurs, such a part significantly vibrates due to the resonance with the result of great noise and influence to the adjusting operation concurrently carried out with the releasing operation. For example, if the vibration propagates to the intermediary transfer belt 7, the density detection of the control patch by the density detecting sensor 29 may be adversely affected. In this embodiment, upon the shifting from the releasing operation to the supplying operation, the variation of the rotational speed of the toner bottle TY is reduced, and therefore, the above-described problem can be avoided.

In addition, according to this embodiment, the second duty ratio DW2 is corrected (STEP8 in FIG. 14) on the basis of the rotational speed (required time period Ti for pump operation) of the toner bottle TY in the releasing operation. By this, as compared with the structure in which the supplying operation starts using the fixed duty ratio, the rotational speed of the toner bottle TY can be quickly made closer to the target rotational frequency N2.

Furthermore, the releasing operation of unsealing the toner bottle TY is carried out after the light quantity adjustment for the optical density sensor and the initializing operation for the developing device 15Y. Therefore, the influence to the light quantity adjustment and the initializing operation by the vibration resulting from the releasing operation can be suppressed.

In addition, the initializing operations for the developing devices are carried out from the developing device 15Y to the developing device 15K in the order in which they are arranged along with the moving direction of the intermediary transfer belt 7, and the releasing operations for the toner bottles TY, TM, TC, TK are carried out in the same order.

The releasing operation for the toner bottle corresponding to the developing device for which the initializing has been finished is carried out concurrently with the initializing operation for the subsequent developing device, that is, for example, the releasing operation for the toner bottle TY is carried out concurrently with the initializing operation for the developing device 15M. By doing so, the time period required for carrying out the installation sequence can be reduced, so that the apparatus can be quickly prepared for the start of the image forming process and/or the supplying operation.

In the above-described embodiment, the present invention has been applied to an intermediary transfer and tandem type color image forming apparatus, but it is applicable to another type of the image forming apparatus provided with a developer accommodating container. The structure of the developer accommodating container is not restricted to that described in the foregoing, and it may be any type if the inside developer can be discharged with the rotation, and for example, it may be provided with a discharging mechanism other than the above-described pump mechanism, such as a screw type, bellows type or provided inside the toner bottle, for example.

This application claims the benefit of Japanese Patent Application No. 2015-209870 filed on Oct. 26, 2015, which is hereby incorporated by reference herein in its entirety.

What is claimed is:

1. A toner supply unit for use in an image forming apparatus for forming an image on a recording material with toner, said toner supply unit comprising:

a main body including a mounting portion for mounting a toner bottle;

a driving device supplying a driving force;

a controller to control the driving force;

a toner bottle containing toner, dismountably mounted to said mounting portion and including a discharging portion for discharging the toner contained therein, said toner bottle being rotatable by a driving force supplied from said driving device;

a detector configured to detect information relating to a number of rotations of said toner bottle;

a movable shutter member provided on said toner bottle and movable between a closing position for closing said discharging portion and an opening position for opening said discharging portion;

a bottle gear provided on said toner bottle and configured to receive the driving force in a state that said toner bottle is mounted to said mounting portion;

a moving mechanism provided in said main body and configured to move said shutter member from the closing position to the opening position with rotation of said bottle gear in the state that said toner bottle is mounted to said mounting portion; and a discharging mechanism provided on said toner bottle and configured to discharge a predetermined amount of toner from said discharging portion with the rotation of said bottle gear, in the state that said toner bottle is mounted to said mounting portion, wherein by control of said controller, the driving force inputted to said bottle gear in a period from input of the driving force to said bottle gear to a predetermined number of detections of the information by said detector is smaller than the driving force inputted to said bottle gear at a time when said discharging mechanism first discharges the predetermined amount of toner from the discharging portion after the predetermined number of detections of the information.

2. The toner supply unit according to claim 1, further comprising a drive transmission mechanism provided in said main body and capable of transmitting the driving force supplied to said bottle gear to said moving mechanism, wherein said drive transmission mechanism transmits the driving force supplied to said bottle gear to said moving mechanism during said shutter member moving from the closing position to the opening position, and wherein after said shutter member moves from the closing position to the opening position, said drive transmission mechanism does not transmit the driving force supplied to said bottle gear to said moving mechanism.

3. The toner supply unit according to claim 1, wherein said controller controls said driving device on the basis of a signal from said detector after the predetermined number of detections of the information, so that a rotational speed of said toner bottle is a predetermined rotational speed.

4. The toner supply unit according to claim 1, wherein said discharging mechanism includes a pump portion capable of expanding and contracting in a direction of a rotational axis of said toner bottle to discharge the predetermined amount of toner from said discharging portion and a cam mechanism capable of converting the driving force supplied to said bottle gear to a force for moving said toner bottle in the direction of the rotational axis, and wherein the predetermined amount of toner is discharged from said discharging portion by execution of the expanding-and-contracting operation of said pump portion with the rotating operation of said bottle gear in the state that said toner bottle is mounted to said mounting portion.

5. The toner supply unit according to claim 4, wherein said controller controls said driving device on the basis of a signal from said detector after the predetermined number of detections of the information, so that a time period for one expansion and contract action of said pump portion is a predetermined time period.

6. The toner supply unit according to claim 1, wherein said driving device includes a DC motor, and said controller controls the strength of the driving force to be applied to said bottle gear, using a pulse width modulation signal.

7. The toner supply unit according to claim 1, wherein said moving mechanism includes a driving gear provided in said main body and configured to engage with said bottle gear to be rotated with the rotation of said bottle gear in the state that said toner bottle is mounted to said mounting portion, and an engageable member provided in said main body and configured to engage with said shutter member to make a relative movement relative to said toner bottle with the rotation of said driving gear in the state that said toner bottle is mounted to said mounting portion, and wherein in the state that said toner bottle is mounted to said mounting portion, said engageable member is capable of moving relative to said toner bottle so that said shutter member moves from the closing position to the opening position with the rotation of said driving gear, in the state that said toner bottle is mounted to said mounting portion.

8. The toner supply unit according to claim 7, wherein in the state that said toner bottle is mounted to said mounting portion, said engageable member is capable of limiting movement of said shutter member relative to said toner bottle such that said shutter member moves from the opening position to the closing position with the rotation of said driving gear, in the state that said toner bottle is mounted to said mounting portion.

9. The toner supply unit according to claim 7, further comprising a worm gear provided in said main body, fixed to said engageable member and movable with the rotation of said driving gear, wherein in the state that said toner bottle is mounted to said mounting portion, said engageable member is slidable integrally with said worm gear to move relative to said toner bottle.

10. A toner supply unit for use in an image forming apparatus for forming an image on a recording material with toner, said toner supply unit comprising:

a main body including a mounting portion for mounting a toner bottle;

a driving device supplying a driving force;

a controller to control the driving force;

a toner bottle containing toner, dismountably mounted to said mounting portion and including a discharging portion for discharging the toner contained therein, said toner bottle being rotatable by a driving force supplied from said driving device;

a detector configured to detect rotation of said toner bottle, a movable shutter member provided on said toner bottle and movable between a closing position for closing said discharging portion and an opening position for opening said discharging portion;

a bottle gear provided on said toner bottle and configured to receive the driving force in a state that said toner bottle is mounted to said mounting portion;

a moving mechanism provided in said main body and configured to move said shutter member from the closing position to the opening position with rotation of said bottle gear in the state that said toner bottle is mounted to said mounting portion; and a discharging mechanism provided on said toner bottle and configured to discharge a predetermined amount of toner from said discharging portion with the rotation of said bottle gear, in the state that said toner bottle is mounted to said mounting portion, wherein by control of said controller, the driving force inputted to said bottle gear in a period from input of the driving force to said bottle gear to a predetermined number of rotations of said toner bottle detected by said detector is smaller than the driving force inputted to said bottle gear at the time when said discharging mechanism first discharges the predetermined amount of toner from the discharging portion after the predetermined number of rotations of said toner bottle.

11. The toner supply unit according to claim 10, further comprising a drive transmission mechanism provided in said main body and capable of transmitting the driving force supplied to said bottle gear to said moving mechanism, wherein said drive transmission mechanism transmits the driving force supplied to said bottle gear to said moving mechanism during said shutter member moving from the closing position to the opening position, and wherein after said shutter member moves from the closing position to the opening position, said drive transmission mechanism does not transmit the driving force supplied to said bottle gear to said moving mechanism.

12. The toner supply unit according to claim 10, wherein said controller controls said driving device on the basis of a signal from said detector after the predetermined number of rotations of said toner bottle, so that a rotational speed of said toner bottle is a predetermined rotational speed.

13. The toner supply unit according to claim 10, wherein said discharging mechanism includes a pump portion capable of expanding and contracting in a direction of a rotational axis of said toner bottle to discharge the predetermined amount of toner from said discharging portion and a cam mechanism capable of converting the driving force supplied to said bottle gear to a force for moving said toner bottle in the direction of the rotational axis, and wherein the predetermined amount of toner is discharged from said discharging portion by execution of the expanding-and-contracting operation of said pump portion with the rotating operation of said bottle gear in the state that said toner bottle is mounted to said mounting portion.

14. The toner supply unit according to claim 10, wherein said controller controls said driving device on the basis of a signal from said detector after the predetermined number of rotations of said toner bottle, so that a time period for one expansion and contract action of said pump portion is a predetermined time period.

15. The toner supply unit according to claim 10, wherein said driving device includes a DC motor, and said controller controls the strength of the driving force to be applied to said bottle gear, using a pulse width modulation signal.

16. The toner supply unit according to claim 10, said moving mechanism includes a driving gear provided in said main body and configured to engage with said bottle gear to be rotated with the rotation of said bottle gear in the state that said toner bottle is mounted to said mounting portion, and an engageable member provided in said main body and configured to engage with said shutter member to make a relative movement relative to said toner bottle with the rotation of said driving gear in the state that said toner bottle is mounted to said mounting portion, and wherein in the state that said toner bottle is mounted to said mounting portion, said engageable member is capable of moving relative to said toner bottle so that said shutter member moves from the closing position to the opening position with the rotation of said driving gear, in the state that said toner bottle is mounted to said mounting portion.

17. The toner supply unit according to claim 16, wherein in the state that said toner bottle is mounted to said mounting portion, said engageable member is capable of limiting movement of said shutter member relative to said toner bottle such that said shutter member moves from the opening position to the closing position with the rotation of said driving gear, in the state that said toner bottle is mounted to said mounting portion.

18. The toner supply unit according to claim 16, further comprising a worm gear provided in said main body, fixed to said engageable member and movable with the rotation of said driving gear, wherein in the state that said toner bottle is mounted to said mounting portion, said engageable member is slidable integrally with said worm gear to move relative to said toner bottle.

* * * * *